United States Patent [19]

Block

[11] 4,218,798

[45] Aug. 26, 1980

[54] FLOOR TREATING MACHINE

[75] Inventor: Thomas S. Block, Muskegon, Mich.

[73] Assignee: Clarke-Gravely Corporation, Muskegon, Mich.

[21] Appl. No.: 49,883

[22] Filed: Jun. 19, 1979

[51] Int. Cl.[3] ..... A47L 11/16

[52] U.S. Cl. ..... 15/49 R; 15/87

[58] Field of Search ..... 15/49 R, 49 C, 49 RB, 15/50 R, 50 C, 50 A, 98, 82, 83–87, 320

[56] References Cited

U.S. PATENT DOCUMENTS

| | | | |
|---|---|---|---|
| 1,801,135 | 4/1931 | Blogg . | |
| 2,121,649 | 6/1938 | Beitman . | |
| 2,278,306 | 3/1942 | Cushman et al. | |
| 2,513,587 | 4/1950 | Reeves | 15/319 |
| 2,526,419 | 10/1950 | Reeves . | |
| 2,558,623 | 6/1951 | Mott . | |
| 2,655,678 | 10/1953 | Keogh | 15/87 |
| 2,978,719 | 4/1961 | Arones | 15/49 R |
| 3,242,521 | 3/1966 | Young . | |
| 3,277,511 | 10/1966 | Little et al. | |
| 3,299,460 | 1/1967 | Burgoon | 15/49 R |
| 3,850,473 | 11/1974 | Huber . | |
| 3,866,541 | 2/1975 | O'Connor et al. | 15/50 R |
| 3,872,777 | 3/1975 | Mastis . | |
| 3,879,789 | 4/1975 | Kasper | 15/50 C |
| 4,006,506 | 2/1977 | Burgoon . | |
| 4,009,500 | 3/1977 | Ashton | 15/50 R |

FOREIGN PATENT DOCUMENTS

| | | | |
|---|---|---|---|
| 1007574 | 5/1952 | France . | |
| 695207 | 8/1953 | United Kingdom . | |
| 1388557 | 3/1975 | United Kingdom | 15/320 |

*Primary Examiner*—Edward L. Roberts

*Attorney, Agent, or Firm*—Price, Heneveld, Huizenga & Cooper

[57] ABSTRACT

A floor treating machine primarily adapted for scrubbing a hard floor surface is disclosed. The machine includes a main frame, a modular support subassembly and a brush subassembly. The support subassembly includes a frame member secured to the main frame and a brush lift assembly. The brush lift assembly includes a main lift arm pivoted to the support frame, a fluid operated diaphragm motor engaging the main lift arm and a tilt arm pivoted at one end to the frame. The main lift arm and tilt arm are operatively connected to the brush subassembly.

30 Claims, 6 Drawing Figures

FLOOR TREATING MACHINE

BACKGROUND OF THE INVENTION

The present invention relates to floor treating apparatus and more particularly to a floor scrubbing machine including means for lifting a brush assembly out of engagement with a floor surface.

Heretofore, a wide variety of floor treating machines have been proposed for cleaning hard floor surfaces. Examples of prior proposals may be found in U.S. Pat. No. 1,801,135, entitled FLOOR SCRUBBING MACHINE and issued on Apr. 14, 1931 to Blogg and U.S. Pat. No. 2,121,649 entitled SCRUBBING MACHINE FOR FLOORS AND FLOOR COVERINGS and issued on June 12, 1938 to Beitman.

Such machines are commonly referred to as floor scrubbers. Presently available scrubbers may be self propelled or pushed by the operator. Such machines typically include a solution tank, a soilage recovery system, at least one scrub brush and a squeegee. Such machines are typically battery powered. The scrub brush is positioned at the front of the machine and a cleaning solution is dispensed on the floor. Dirt, grime, oil and grease, etc., are scrubbed from the surface by the brush. The recovery system and squeegee remove the dirty solution or soilage from the floor surface and which is directed to a recovery tank. After passage of the machine, the floor is essentially dry and ready for immediate use.

Floor scrubbers are provided in a variety of sizes to meet the specific requirements of the user. When large floor areas must be cleaned, automatic scrubbing machines which are self contained and self powered are usually selected. Such machines may be capable of cleaning up to thirty thousand square feet in an hour. The prior scrubbers have basically been integral units with little part interchangeability between the various sizes. Problems have been experienced with ease of manufacture, cost of manufacture, reliability and ease of maintenance.

The larger floor scrubbing machines typically employ two vertical axis rotary scrub brushes. The brushes should be raisable off the floor surface when traversing large areas and cleaning is not desired. If the brushes are left in engagement with the floor, and excessive wear may occur. It is also desirable to adjust brush aggressiveness or the pressure that the brush exerts on the floor during operation. This, however, has not been readily controllable with the heretofore proposed scrubbers. Such scrubbers may provide only manual brush height adjustment, if at all, and independent provision is usually not made for controlling brush aggressiveness. With manual systems, the operator cannot adjust brush height from the control panel of the machine.

Also, difficulties are experienced with replacement of worn brushes. In commercial use, the brushes are subject to heavy use and the bristles wear requiring replacement at frequent intervals. Most large automatic scrubber machines require substantial disassembly in order to gain access to the brush elements for replacement. Due to the difficulties experienced in performing required maintenance, such may not be performed at all by the operator or such is delayed excessively. This, of course, may result in ineffective cleaning of the floor surface.

A need exists for a scrubber which has reduced complexity, a reduction in the cost of manufacture, an increase in ease of assembly, an increase in ease of use and in the performance of required maintenance.

SUMMARY OF THE INVENTION

In accordance with the present invention, a unique floor scrubber is provided including a modular support subassembly whereby the problems heretofore experienced are substantially alleviated. Essentially, the floor treating machine includes a modular support means having a brush lift means operatively connectable to a brush housing for raising and lowering the brush housing. The brush lift means includes a main lift arm pivoted at one end to the modular support means and a fluid operated diaphragm motor for pivoting the main lift arm. In narrower aspects of the invention, provision is made for tilting the brush housing about a transverse axis upon lifting of the brush housing in order to provide ease of access to the brush elements for replacement. Provision is made for controlling brush aggressiveness by regulating the pressure of the fluid directed to the diaphragm motor.

The brush lift means permits the brush to be moved out of contact with the floor surface during storage and when moving the machine to an area for use. The modular approach permits complete interchangeability with various sizes of scrubbers. Also, different sizes of brush assemblies may be employed with the modular support means. The fluid operated diaphragm motor reduces the compressor capacity required when compared with piston cylinder actuators, for example. Due to the positioning of the main lift arm relative to the diaphragm motor or actuator in the preferred construction of the present invention, a short stroke actuator may be employed. The apparatus in accordance with the present invention possesses the desirable attributes of reduced complexity, reduced cost of manufacture, increased ease of manufacture and assembly, increased reliability and increased ease of maintenance.

DETAILED DESCRIPTION OF THE PREFERRED EMBODIMENT

Figure 1:
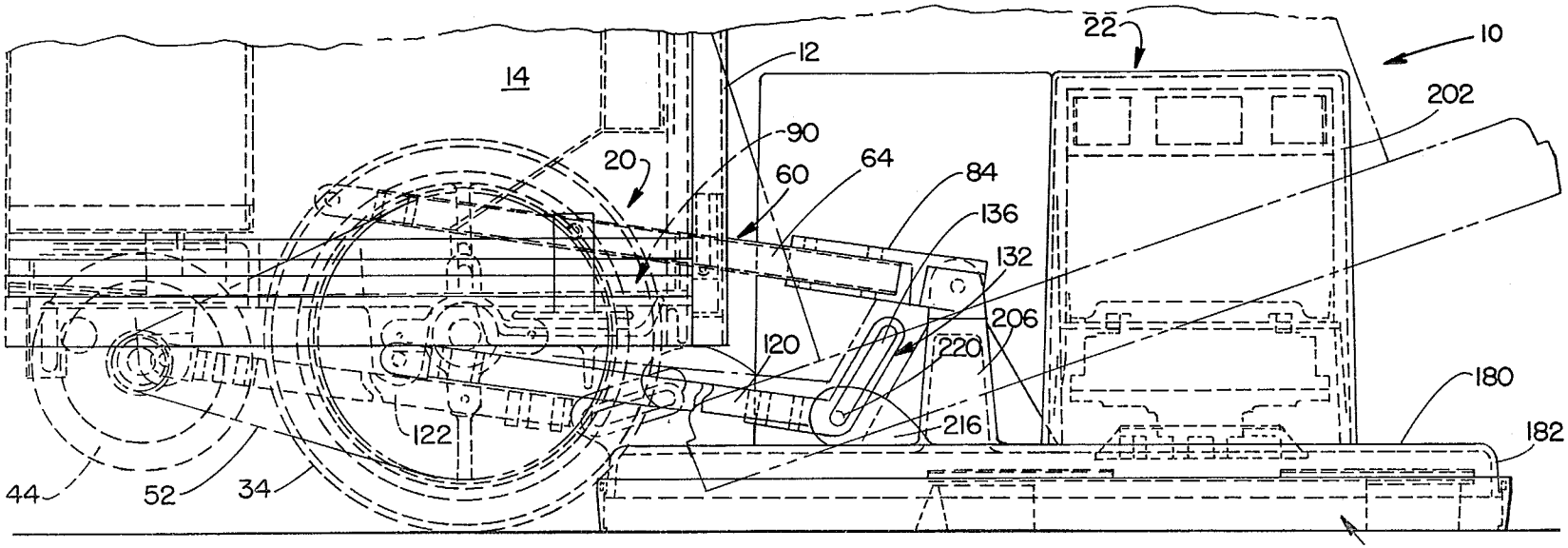
FIG. 1 is a fragmentary, side elevational view of a floor treating machine in accordance with the present invention.

With reference to the drawings, FIG. 1 partially illustrates a floor treating machine in accordance with the present invention generally designated 10. The floor treating machine is an automatic floor scrubber including a main frame structure 12 supporting a solution tank, a wet soilage recovery tank, an operator control panel and the necessary pumps, valves, tubing, etc. The components of the scrubber are suitably enclosed within a housing or enclosure structure 14. The floor scrubber also includes a suitable vacuum soilage recovery apparatus and a squeegee subassembly. Since these structures are well known and may be conventional in nature, they are not illustrated or described in detail herein. Reference is made, however, to commonly owned application Ser. No. 049,884, entitled SQUEEGEE FOR FLOOR TREATING MACHINE filed on even date herewith in the name of the present inventor for a more detailed description of a squeegee subassembly which may be incorporated in the floor scrubber.

The floor scrubber 10, in accordance with the present invention, includes a modular support subassembly generally designated 20 and a brush head subassembly generally designated 22. Since the present invention is primarily directed to the unique modular support subassembly and the brush head subassembly, the remaining well-known details of an automatic floor scrubber will not be described.

MODULAR SUPPORT SUBASSEMBLY

Figure 2:
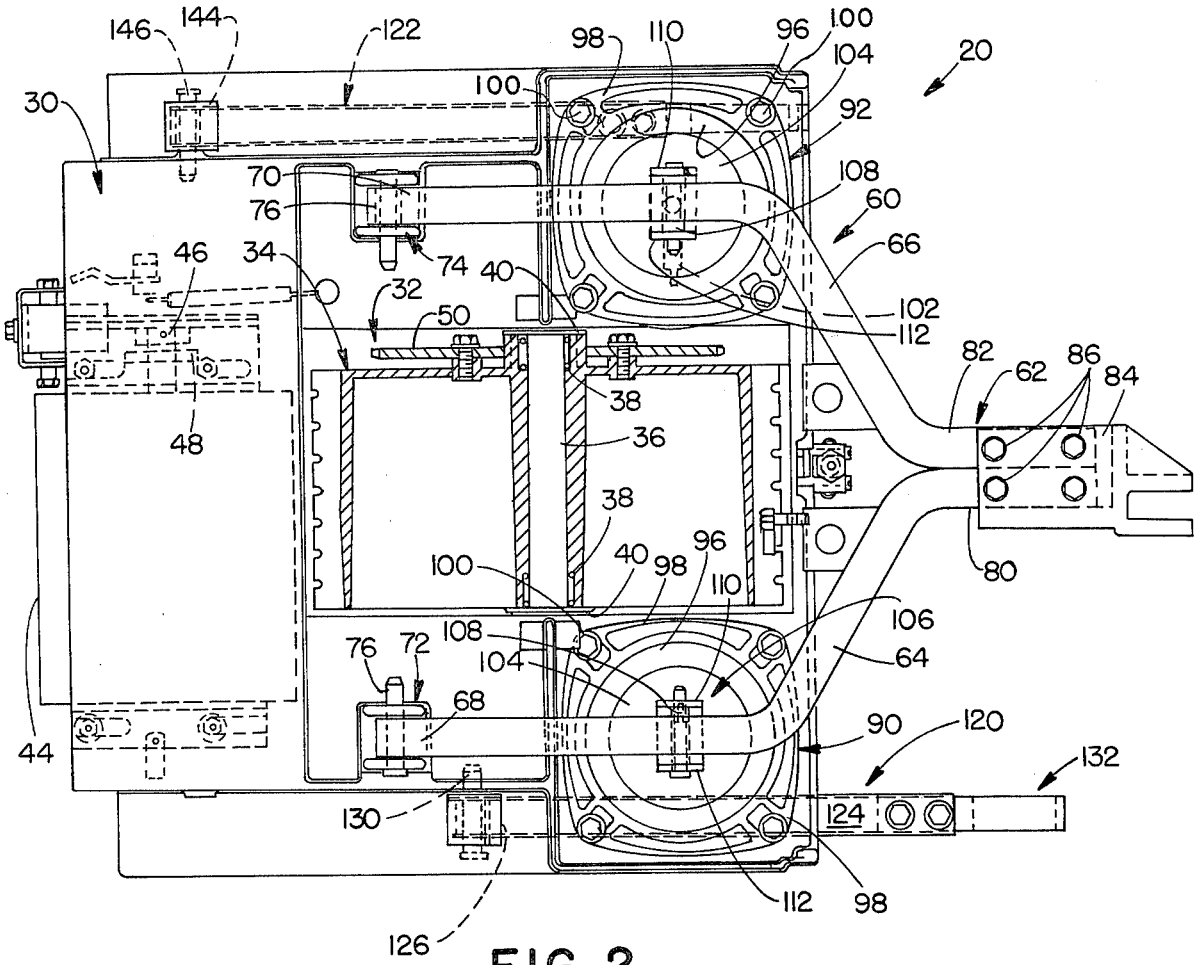
FIG. 2 is a top plan view of a floor treating machine support subassembly incorporated in the present invention.
Figure 3:
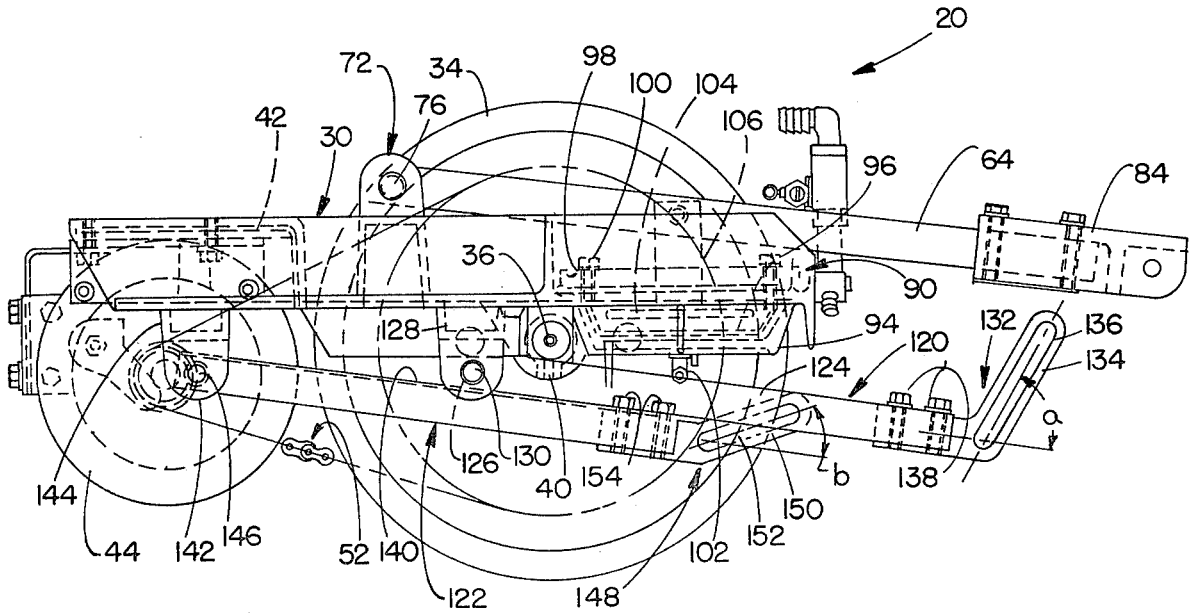
FIG. 3 is a side elevational view of the support subassembly.

Support subassembly 20 is best seen in FIGS. 2 and 3. As shown therein, support subassembly 20 includes a main frame member or support plate 30. Support plate 30 is secured by suitable fasteners or is welded to main frame 12 of scrubber 10. Support plate 30, in the preferred embodiment, defines a generally rectangular aperture 32. Rotatably supported within aperture 32 is a ground engaging wheel 34. Wheel 34 is rotatably mounted on an integral axle 36 by suitable bearings 38. Axle 36 is affixed to bracket members 40 on plate 30. Mounted generally rearwardly of wheel 34 and secured to an undersurface 42 of support plate 30 is a suitable electric motor 44. Electric motor 44 has an output shaft 46 to which a sprocket 48 is nonrotatably secured. Secured to wheel 34 is a driven sprocket 50. Power is transmitted from motor 40 to wheel 34 by a flexible transmission member which is preferably a roller chain 52, schematically shown in FIG. 3.

Subassembly 20 is a module containing the drive components for the automatic floor scrubber. The plate may be interchangeably employed with different sizes of floor scrubbers having different sized solution and recovery tanks, etc. This modular approach to the support subassembly significantly increases the ease of manufacture and reduces the cost associated therewith when a family of scrubbers are manufactured.

As seen in FIG. 1, plate 30 supports a brush lift means generally designated 60 which is operatively connected to brush head subassembly 22. As best seen in FIGS. 2 and 3, brush lift means 60 includes an upper main lift arm 62. In the preferred form, main lift arm 62 is a generally Y-shaped or bifurcated member defined by a righthand arm section 64 and a lefthand arm section 66. Rear ends 68, 70 of arms 64, 66, respectively, are pivotally secured to the support plate 30 at brackets 72, 74, respectively. Suitable pivot or connecting pins 76 extend through the respective brackets 72, 74 and the rear portions 68, 70 of the main lift arm 62. Forward portions 80, 82 of arm sections 64, 66 define a stem and are joined by a connector bracket or coupling 84. Suitable fasteners 86 extending through coupling 84 secure the arms thereto. Coupling 84, as discussed in detail below, is pivotally connected to the brush head assembly 22.

Positioned below sections 64, 66 of main lift arm 62 are a pair of short stroke, fluid operated diaphragm motors or actuators 90, 92. Actuator 90 engages arm portion 64 and actuator 92 engages arm portion 66. Each actuator 90, 92 is of identical construction and, as best seen in FIGS. 2 and 3, includes a cup-shaped housing 94 defined by plate 30 and opening through an upper surface thereof. Positioned within the cup-shaped housing 94 is a suitable, resilient, flexible cup-shaped diaphragm 96. Diaphragm 96 is retained on housing 94 by a clamp 98 of annular configuration. Suitable fasteners 100 extend through clamp 98 and into plate 30 to secure clamp 98 and diaphragm 96 in place. Communicating with housing 94 is a suitable fitting 102 which, as explained below, is connected through a control system to a source of pressurized fluid.

Positioned above diaphragm 96 and operatively engaged thereby is a piston 104 of generally disc shape. Extending centrally of piston 104 is a stem 106. Each stem 106 is pivotally connected to a respective one of the arms 64, 66 by a suitable pivot pin 108. In the preferred construction, each stem 106 comprises a U-shaped member having a pair of spaced, parallel, vertically oriented portions 110, 112 which straddle respective sections 64, 66 of main lift arm 62.

As should be readily apparent, upon the introduction of a fluid, preferably air, under pressure into housing 94 the chamber defined by diaphragm 96 and housing 94 will expand as the diaphragm moves outwardly of the housing. The diaphragm will engage piston 104 causing main lift arm 62 to pivot about pins 76. This, in turn, causes the brush head subassembly 22 to be lifted from the floor surface.

Secured to the undersurface of plate 30 are tilt links or stabilizing arms 120, 122. As best seen in FIG. 3, arm 120 is an elongated member including a channel-shaped, elongated portion 124 having a rear end 126 pivotally secured to plate 30 at a bracket 128 by a pivot pin 130. A forward portion 132 of arm 120 includes an upwardly angled section 134 defining an elongated slot 136. In the preferred construction, portion 132 is a separate member secured to elongated, generally channel-shaped portion 124 by suitable fasteners 138.

Arm 122 is similar to arm 120 in that it includes an elongated, channel-shaped portion 140 having an end 142 pivotally secured to the undersurface of plate 30 at a bracket 144 by a pivot pin 146. A forward portion 148 includes an upwardly angled section 150 defining an elongated slot 152. Forward portion 148 in the preferred construction is a separate piece secured to elongated portion 140 by suitable fasteners 154. For reasons which will become readily apparent, the acute, upward angle, generally designated "a" in FIG. 3 of section 134 is greater than the acute upward angle, generally designated "b", of section 150. Links or arms 120, 122 in cooperation with the main lift arm 62 cause the brush head assembly 22 to tilt or pivot about an axis transverse of plate 30 upon raising and lowering motion.

BRUSH HEAD SUBASSEMBLY

Figure 4:
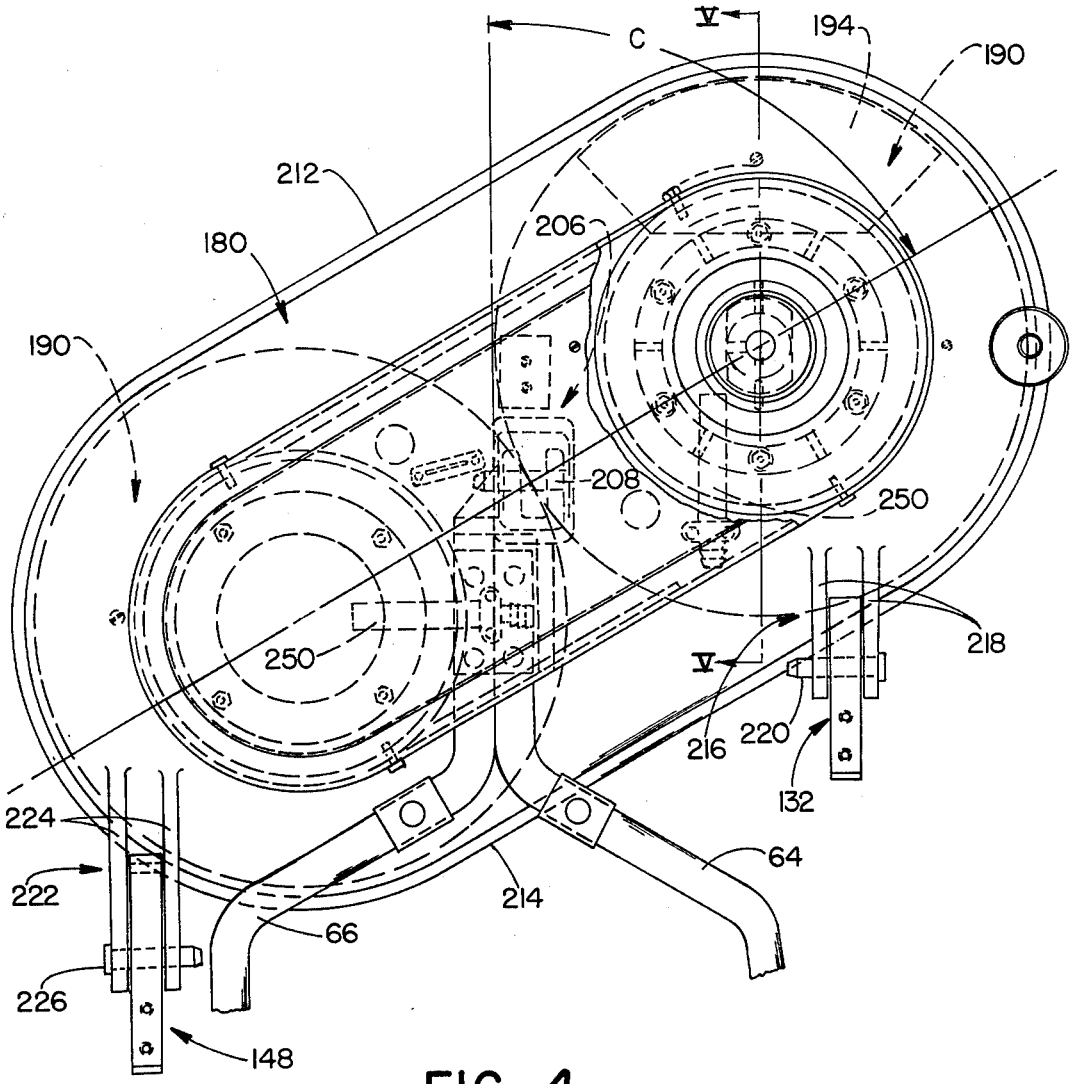
FIG. 4 is a top plan view of a brush head subassembly.
Figure 5:
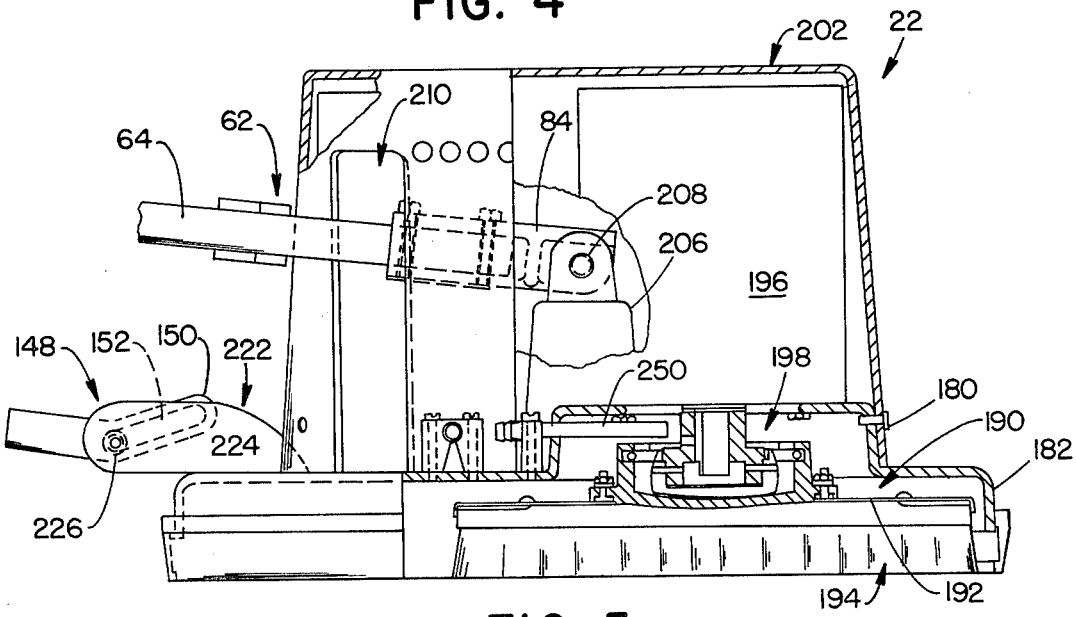
FIG. 5 is a cross-sectional view taken generally along line V—V of FIG. 4.

As seen in FIGS. 1, 4 and 5, brush head assembly 22 includes a brush housing 180 defining a peripheral, depending skirt 182. Supported within housing 180 are a pair of vertical axis rotary scrub brushes 190. Each scrub brush 190 includes a brush holder plate 192 and a plurality of brush segments 194. A more detailed description of brushes 190 may be found in commonly owned, copending application Ser. No. 035,393, entitled VERTICAL AXIS BRUSH and filed on May 2, 1979 in the name of the present inventor. To the extent necessary, the disclosure of this copending application is hereby incorporated by reference. Brushes 190 are preferred over more conventional brushes since they permit ready and easy replacement of segments 194 when they become worn. The manner of replacing the brush segments and access to the segments is readily accomplished by the brush lift means in accordance with the present invention due to tilting of the assembly upon lifting. This will be discussed further below.

Each brush plate 192 is secured to a suitable electric drive motor 196 by a gimbal drive interconnection 198. A detailed description of the gimbal drive interconnection 198 may be found in commonly owned copending application Ser. No. 049,876 entitled GIMBALLED BRUSH DRIVE and filed on even date herewith in the name of the present inventor. The disclosure of said copending application, to the extent necessary, is hereby incorporated by reference. Other forms of drive interconnections between the brushes 190 and the drive motors 196 may, of course, be employed.

The motors are covered by a motor cover or enclosure 202. As best seen in FIG. 4, housing 180 is positioned relative to support plate 30, the main frame 12 of the scrubber and upper main lift arm 62 at an acute angle relative to the longitudinal axis of the machine. This angle is generally designated "c" in FIG. 4. As a result, brushes 190 overlap as the machine transverses over a floor surface thereby insuring that the surface covered by the machine is completely scrubbed.

As seen in FIGS. 4 and 5, extending upwardly and centrally from housing 180 is a main lift bracket 206. Lift bracket 206 is enclosed by motor enclosure 202. Coupling 84 of the main lift arm 62 is pivotally connected to the main lift bracket 206 by a pivot pin 208. Arm 62 extends through an elongated vertical slot 210 (FIG. 5) in enclosure 202. Bracket 206 is located at the center of gravity of brush head subassembly 22 and upward pivotal movement of arm 62 alone would raise the brush head subassembly away from the floor surface. The subassembly 22 would be balanced about the pivot point 208 and would remain essentially horizontal. Tilt links or arms 120, 122 are operatively connected to housing 180 in order to stabilize the subassembly 22 and also tilt the subassembly about a transverse or horizontal axis so that a forward or leading edge 212 of housing 180 will be tilted upwardly relative to a trailing or rear edge 214 of the housing. This upward tilting of the housing permits easy access to brushes 190 for removal of the entire brush assemblies or for removal and replacement of brush segments 194.

As best seen in FIGS. 1, 4 and 5, forward portion 132 of arm 120 is slidably connected to housing 180 at a bracket or lug 216. Lug 216 comprises a pair of spaced, parallel plates 218 formed integral with or suitably secured to housing 180. Extendng between plates 218 is a connecting pin 220. Connecting pin 220 extends through and is slidably received in elongated slot 136.

In a similar fashion, forward portion 148 of arm 122 is slidably connected to housing 180 by a lug 222 defined by a pair of ears or plates 224. Ears 224 are formed integral with housing 180 or otherwise suitably secured thereto. A connecting pin 226 extends between plates 224 and is slidably received within elongated slot 152 of forward portion 148.

Forward portions 132 and 148 are angled upwardly at different angles since the longitudinal axis of housing 180 is not perpendicular to the longitudinal axis of the machine. As a result of the selected angles, upon upward pivotal movement of main lift arm 62, pins 220, 226 will slide within respective slots 136, 152 so that housing 180 will tilt about an axis through pin 208 transverse to the longitudinal axis of the scrubber. This tilting action is shown in phantom in FIG. 1. The operating position of the brush head assembly is shown in solid lines in FIG. 1. As brush head subassembly 22 is raised from the floor surface, lower links or arms 120, 122 will also pivot about their axes after connecting pins 220, 226 have slid through the entire length of the respective slots.

It should be understood that only one of the lower links or arms 120, 122 would be necessary to effect tilting action of the housing upon raising of the brush head subassembly. Two arms in spaced, parallel transverse relationship are employed, however, to provide stability to the brush head subassembly 22 when it is raised. The arms reduce racking of the housing about main pivot pin 209 and therefore reduce torsional and transverse stresses which may be induced on pivot pin 208. This increases the ruggedness, reliability and life of the brush lift subassembly.

As seen in FIG. 5, suitable connecting tubes 250 are supported on housing 180 above each brush assembly 190. Tubes 250 are connected by suitable tubing or hosing (not shown) to the solution tank of the floor scrubber. Cleaning solution is, therefore, deposited centrally of the vertical axis brushes 190 during operation of the scrubber.

PNEUMATIC CONTROL SYSTEM

Figure 6:
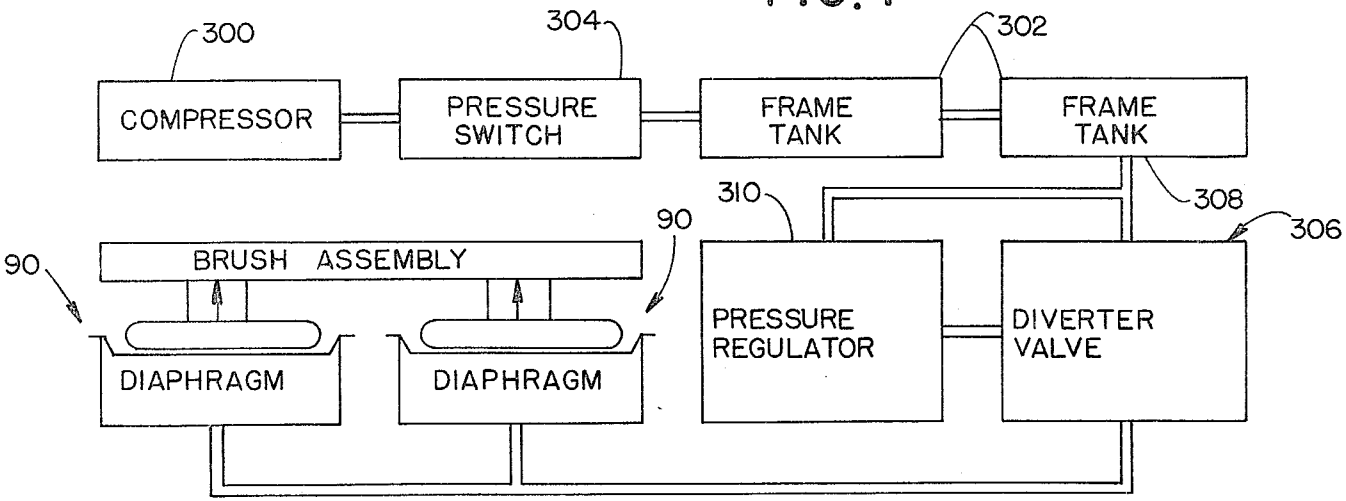
FIG. 6 is a schematic diagram of a pneumatic control system.

A pneumatic control system for operating the brush lift means in accordance with the present invention is schematically illustrated in FIG. 6. As shown therein, the system includes a suitable source of fluid under pressure such as an air compressor 300. Compressor 300 is operatively connected to a reservoir or tank 302 through a suitable pressure switch 304. In the preferred construction, reservoir 302 is defined by the main frame 12 of the sweeper. The main frame 12 is preferably fabricated from tubular, air tight, welded components. The frame members, therefore, define the pressure reservoir tank.

The frame tank or reservoir 302 is connected to the diaphragm motors or actuators 90 through a diverter valve 306. Frame tanks 302 have an outlet 308 connected to both the diverter valve 306 and a pressure regulator 310. Valve 306 selectively places the diaphragm actuator 90 either directly in communication with the air under pressure from frame tanks 302 or in communication with air under pressure in the frame tanks through the pressure regulator 310.

The control system may be employed to control the brush aggressiveness of the floor scrubber. When connected directly to the frame tank through the diverter valve, diaphragm actuators 90 will lift the main lift arm 62 through their full stroke thereby raising brush head subassembly 22 completely out of engagement with the floor surface. When connected through the pressure regulator, a reduced pressure is maintained within the housings of the actuators 90 which merely reduces and controls the pressure that the brushes 190 exert on the floor surface.

The brush lift mechanism readily accommodates itself to a simple control system having only four main components, namely the compressor, the frame tank, the diverter valve and the pressure regulator. Diverter valve 306 is a readily available commercial item having a pair of inlets and a single outlet. It is preferred that the valve be solenoid operated. The pressure regulator, the compressor and the pressure switch are readily available commercial items. Further, the diaphragms are readily available commercial actuators which are of the general type heretofore employed in air brake systems, for example.

OPERATION

As should be readily apparent from the above description, drive motor 44 may be actuated through a suitable control system (not shown) by the scrubber operator. As a result, main drive wheel 34 is rotated to propel the sweeper along a floor surface. With the pistons of diaphragm actuators 90 in their fully retracted positions, the brush head subassembly will be fully lowered and brushes 190 will be in contact with the floor surface. Cleaning solution is dispensed to the brushes and the scrubbing action removes the dirt, oil, grease, etc., from the floor. When it is desired to raise the brush head assembly from the floor surface, the diverter valve 306 is actuated so that motors 90 are in direct communication with the frame tank reservoir 302. Pistons 104 will extend through their full stroke thereby raising main lift arm 62. Parallel lower links, stabilizing or tilt arms 120, 122 due to their sliding interconnection with housing 180 cause the brush housing to tilt about an axis transverse to the machine. When it is desired to commence scrubbing operation, air is exhausted from the actuators 90 and arm 62 is lowered to place brushes 190 into working engagement with the floor surface. If it is desired to reduce the brush pressure exerted on the floor surface, diverter valve 306 is actuated to direct air to diaphragm actuators 90 through pressure regulator 310. This will slightly raise brush housing 180 thereby reducing the pressure the brushes exert on the floor surface and controlling brush aggressiveness. When in the fully lowered position, main lift arm 62 will stop against a forward leading edge of frame member or support plate 30. The support plate, therefore, also limits movement of the housing 180.

The modular concept for the support subassembly permits the same assembly to be employed with different sizes of floor scrubbers. The unit is self contained in that it includes a scrubber drive and a brush lift means. Different sizes of brush head assemblies 22 may be connected to arms 62, 120 and 122. These features provide increased versatility to the scrubber manufacturer and reduce the overall cost of manufacture necessary to provide a complete line or family of different sizes of floor scrubbers.

The use of fluid operated diaphragm actuators also reduces the cost of the brush lift assembly when compared to a lift mechanism employing piston cylinder assemblies. The housing of the diaphragm may be formed as an integral part of the support plate 30 which thereby further reduces the cost of manufacture. By positioning the actuators 90 closer to the rear pivot points of arm portions 64, 66 than to the coupling 84 full advantage of the lift and minimum stroke capabilities of diaphragm actuators 90 is employed. Use of the diaphragm actuators and their relative positioning permits the entire subassembly 20 to be positioned within the confines of the main frame 12 of the floor scrubber. This results in an aesthetically pleasing scrubber construction. This feature also reduces the chance of damage to the brush lift mechanism during operation since it is enclosed within the main frame.

Use of the main frame as the pressure reservoir for the pneumatic control system reduces manufacturing costs since the need for separate reservoir tanks is eliminated. This also reduces the space needed to support all of the equipment of the scrubber within the confines of the main frame and enclosure. Easy access is had to brush assemblies 190 to permit replacement of the brush assemblies and/or replacement of individual segments. This, therefore, increases the ease of maintenance as well as the reliability and ultimate efficiency of the machine.

The structural components of subassemblies 20 and 22 are easily manufactured employing conventional techniques. Housing 180, for example, may be die cast and machined or stamped. Arms 62, 120 and 124 are readily fabricated from channel steel and plate 30 may be a die cast item. A minimum of parts are employed which also increases the ease of assembly and reduces cost of manufacture. The control system permits brush force to be varied and equally applied to each brush whether such is new or worn. The raising and tilting action of the brush lift mechanism provides adequate clearance for mounting and removal of the brushes. Use of a pressure regulator insures constant pressure when control of brush aggressiveness is desired. Since the diaphragm actuators reduce the compressor size requirements when compared to piston cylinder pneumatic actuators, the size of and/or number of storage batteries is reduced.

In view of the foregoing description, those of ordinary skill in the art will undoubtedly envision various modifications to the embodiment illustrated which would not depart from the inventive concepts disclosed herein. For example, an elongated upper control arm which is not bifurcated could be employed in place of the Y-shaped arm illustrated. Further, depending upon the weight and size of the brush head subassembly, it is possible that only a single actuator 90 need be employed. Further, as discussed above, only a single link or arm 120, 122 is necessary for effectuating the tilting action of the brush head subassembly. Therefore, it is expressly intended that the above description should be considered only as that of the preferred embodiment. The true spirit and scope of the present invention may be determined by reference to the appended claims.

The embodiments of the invention in which an exclusive property or privilege is claimed are defined as follows.

1. A floor treating machine of the type having a frame, a ground engaging wheel supporting the frame, a brush housing enclosing a vertical axis, rotary floor treating brush and brush lift means for lifting the brush housing away from the floor and lowering the housing towards the floor, said brush lift means comprising:

a main lift arm pivoted at a rear end to the frame and at a front end to the brush housing;

a fluid operated diaphragm motor supported on the frame and engaging the main lift arm between its rear end and its front end; and tilt means on said frame and operatively engaging said brush housing for tilting the housing about a horizontal axis in response to movement of the main lift arm as the fluid operated diaphragm motor engages and pivots the main lift arm to lift and lower the brush housing.

2. A floor treating machine as defined by claim 1 further including a source of fluid under pressure and control means connecting the fluid to the diaphragm motor for controlling the operation of the diaphragm motor.

3. A floor treating machine as defined by claim 1 wherein said fluid operated diaphragm motor comprises:

a cup-shaped housing connectable to a controlled source of pressurized fluid;

a flexible cup-shaped diaphragm clamped to the housing and movable away from a bottom wall of the housing upon the introduction of fluid under pressure into the housing; and a disc-shaped piston positioned above the diaphragm and including a stem operatively connected at its upper end to the main lift arm at a point intermediate the ends of the main lift arm and closer to the end of the lift arm pivoted to the frame.

4. A floor treating machine as defined by claim 1 wherein said tilt means comprises:

an elongated link having a rear end and an upwardly angled front end portion, said rear end being pivoted to the frame at a point below the pivot point of the main lift arm, said front end portion including an elongated slot therein; and a member fixed to the brush housing at a point below the connection of the main lift arm to the housing, said member freely sliding within the elongated slot of said link whereby as said main lift arm is raised, said member will ride in the elongated slot causing a forward end of the brush housing to tilt upwardly and said housing to rotate about a horizontal axis.

5. A floor treating machine as defined by claim 4 wherein said tilt means further includes:

a stabilizing link having a rear end and an upwardly angled front end, said front end of the stabilizing link having a slot therein, the rear end of the stabilizing link being pivoted to the frame; and another fixed member secured to said brush housing and freely riding within the slot of the stabilizing link.

6. A floor treating machine as defined by claim 4 further including a source of fluid under pressure and control means connecting the fluid to the diaphragm motor for controlling the operation of the diaphragm motor.

7. A floor treating machine as defined by claim 6 wherein said tilt means further includes a stabilizing link having a rear end and an upwardly angled front end, said front end of the stabilizing link having a slot therein, the rear end of the stabilizing link being pivoted to the frame, and another fixed member secured to said brush housing and freely riding within the slot of the stabilizing link.

8. A floor treating machine as defined by claim 7 wherein said control means includes means for controlling brush aggressiveness by maintaining a fluid in said diaphragm motor at a pressure less than the pressure necessary to lift fully the main lift arm.

9. A floor treating machine as defined by claim 8 wherein said fluid operated diaphragm motor comprises:

a cup-shaped housing connected to the source of fluid under pressure;

a flexible cup-shaped diaphragm clamped to the housing and movable away from a bottom wall of the housing upon the introduction of fluid under pressure into the housing; and a disc-shaped piston positioned above the diaphragm and including a stem operatively connected at its upper end to the main lift arm at a point intermediate the ends of the main lift arm and closer to the end of the lift arm pivoted to the frame.

10. A floor treating machine as defined by claim 9 wherein said control means comprises:

a fluid reservoir connected to the source of fluid;

a pressure regulator having an inlet connected to the reservoir and an outlet; and a diverter valve having an outlet selectively connectable to the reservoir directly and to the outlet of the pressure regulator, said diverter valve outlet being connected to the diaphragm motor so that when the valve is in a first position, fluid under pressure is communicated from the reservoir to the diaphragm motor to lift the main lift arm and when the valve is in a second position, fluid under a reduced pressure is communicated to the diaphragm motor from the reservoir through the regulator to control brush aggressiveness.

11. A floor treating machine as defined by claim 10 wherein the frame of the floor treating machine comprises at least one hollow tubular member which defines said fluid reservoir.

12. A modular floor treating machine support assembly usable with a machine including a frame and a brush housing for supporting the frame on a floor surface, said support assembly comprising:

a support plate securable to the frame of the machine;

a support wheel rotatably mounted on said support plate;

brush lift means mounted on said plate and operably connectable to a brush housing for raising and lowering the brush housing relative to a floor surface, said brush lift means including a main lift arm pivoted at one end to the support plate, and a fluid operated diaphragm motor on said support plate for rotating the main lift arm about its pivot point, said main lift arm being operably connectable to the brush housing at its other end and said motor engaging the main lift arm closer to the pivoted end of the lift arm than the end connectable to the brush housing; and drive means mounted on the support plate and operatively connected to the support wheel for driving the support wheel, said brush lift means further including tilt means for tilting the brush housing connected to the main lift arm about an axis transverse to the support plate so that a forward edge of the housing will be raised above a rear edge thereof.

13. A modular floor treating machine support assembly as defined by claim 12 wherein said tilt means comprises a lower arm having a rear end pivoted to the support plate and an angled front end portion, said front end portion defining a slot.

14. A modular floor treating machine support assembly as defined by claim 12 wherein said tilt means comprises:

a first lower arm having a rear end pivotally connected to the support plate and including an upwardly angled forward end portion; and a second lower arm transversely spaced from said first lower arm and pivoted at a rear end to the support plate, said second lower arm including an upwardly angled forward end portion, said forward end portions of said first and second lower arms including means for slidably connecting the forward end portion to the brush housing.

15. A modular floor treating machine support assembly as defined by claim 14 wherein said main lift arm comprises a bifurcated member having a pair of arm sections the rear ends of which are pivotally connected to the support plate, said arm sections joining together at their forward ends to define a stem, said stem being connectable to the brush housing.

16. A modular floor treating machine support assembly as defined by claim 15 wherein said diaphragm motor operably engages one of said arm sections and said assembly further includes another fluid operated diaphragm motor on said support plate and operatively engaging the other arm section.

17. A modular floor treating machine support assembly as defined by claim 16 wherein each of said diaphragm motors comprises a cup-shaped housing defined by said support plate; a flexible cup-shaped diaphragm secured to said support plate and positioned within said cup-shaped housing; a piston positioned above said diaphragm and including a stem operatively connected to one of said parallel arms.

18. An apparatus for a floor treating machine comprising:

a frame member securable to a main frame of a floor treating machine;

a brush head assembly including a housing supporting at least one floor treating brush; and brush head assembly lift means mounted on said frame member and connected to said brush head assembly housing for raising and lowering said brush head assembly relative to a floor surface, said lift means including means for tilting the housing about an axis transverse of the frame member upon raising and lowering of the brush head assembly housing.

19. An apparatus as defined by claim 18 wherein said lift means comprises at least one short stroke, fluid operated diaphragm motor mounted on said frame member for raising and lowering said housing.

20. An apparatus as defined by claim 19 wherein said lift means comprises:

a main lift arm having a rear end and a forward end, said main lift arm being pivotally connected to the frame member at the rear end and to the brush head assembly at its forward end, said diaphragm motor being operatively connected to said main lift arm at a point closer to the rear end than the front end.

21. An apparatus as defined by claim 20 wherein said means for tilting comprises a lower tilt arm pivotally connected to the frame member at a point below the main lift arm, said lower tilt arm including an upwardly angled forward end portion; and means for slidably interconnecting the forward end portion of the tilt arm to the brush head assembly housing.

22. An apparatus as defined by claim 21 wherein said slidably interconnecting means comprises said forward end portion of said tilt arm defining an elongated slot, and a connecting pin riding within said slot and connected to said brush head assembly housing.

23. An apparatus as defined by claim 19 wherein said means for tilting comprises a pair of transversely spaced parallel tilt arms, each arm having a rear end pivotally connected to the frame member and an angled forward portion; and mean for each tilt arm for slidably interconnecting each tilt arm to the brush head assembly housing.

24. An apparatus as defined by claim 23 wherein said lift means further comprises a main lift arm positioned above said tilt arms and having a forward end pivotally connected to said brush head assembly housing above the means for slidably connecting the tilt arms to the brush head assembly housing, said diaphragm motor being positioned below and operatively engaging said main lift arm.

25. An apparatus as defined by claim 24 wherein each of said means for slidably interconnecting each tilt arm comprises a connecting pin fixed to the brush head assembly housing and each of said tilt arms forward end portions defining an elongated slot within which said connecting pin slidably rides.

26. An apparatus as defined by claim 25 wherein said main lift arm is a generally Y-shaped member in plane and the ends of the arms of the Y-shaped member are pivoted to said frame member, said diaphragm motor engaging one of said arms of the Y-shaped member, said lift means further including another short stroke fluid operated diaphragm motor mounted on said frame and operatively engaging the other of said arms of said Y-shaped member.

27. An apparatus as defined by claim 26 wherein each of said diaphragm motors comprises:

a cup-shaped housing defined by said frame member;

a flexible cup-shaped diaphragm clamped to said frame member and disposed within said housing;

a disc-shaped piston positioned above said diaphragm and raised and lowered by said diaphragm; and a stem extending from said piston and pivotally connected to said main lift arm.

28. An apparatus as defined by claim 27 further including:

a floor engaging drive wheel rotatably mounted on said frame member; and a drive motor operatively connected to said drive wheel.

29. An apparatus as defined by claim 27 wherein said brush head assembly includes a pair of vertical axis floor treating brushes supported within said brush head assembly housing.

30. An apparatus as defined by claim 28 wherein said brush head assembly housing is connected to said main lift arm and said tilt arms so that its longitudinal axis is positioned at an acute angle to the longitudinal axis of said main lift arm.

* * * * *

UNITED STATES PATENT AND TRADEMARK OFFICE

CERTIFICATE OF CORRECTION

PATENT NO. : 4,218,798

DATED : August 26, 1980

INVENTOR(S) : Thomas S. Block

It is certified that error appears in the above-identified patent and that said Letters Patent are hereby corrected as shown below:

Column 1, line 17:
"June 12" should be --June 21--;

Column 1, line 47:
After "floor," delete --and--;

Column 4, line 26:
After "about" insert --pivot--;

Column 5, line 52:
"Extendng" should be --Extending--;

Column 6, line 16:
"209" should be --208--;

Column 12, line 7:
"mean" should be --means--.

Signed and Sealed this

*Thirteenth* Day of *January 1981*

[SEAL]

*Attest:*

*Attesting Officer*

SIDNEY A. DIAMOND

*Commissioner of Patents and Trademarks*